United States Patent [19]

Rezmer et al.

[11] Patent Number: 5,004,024

[45] Date of Patent: Apr. 2, 1991

[54] SEALABLE FUNNEL FOR MEASUREMENT AND SPILL PREVENTION

[76] Inventors: Leonard D. Rezmer, 1135 S. 9 Mile Rd., Kawkawlin, Mich. 48631; John R. Kaczmarczyk, 4099 W. Dodge, Clio, Mich. 48420; Gerald R. Kaczmarczyk, G 6447 N. Saginaw, Clio, Mich. 48420; Donald J. Kaczmarczyk, 6460 Estrelle, Mt. Morris, Mich. 48458

[21] Appl. No.: 441,942

[22] Filed: Nov. 27, 1989

Related U.S. Application Data

[63] Continuation-in-part of Ser. No. 325,308, Mar. 17, 1989, abandoned.

[51] Int. Cl.[5] ..... B65B 39/00; B67C 11/00

[52] U.S. Cl. ..... 141/298; 141/331; 141/312; 141/335; 141/340; 141/336

[58] Field of Search ..... 141/331, 332–336, 141/340, 349, 312, 345, 298

[56] References Cited

U.S. PATENT DOCUMENTS

| | | | |
|---|---|---|---|
| 591,894 | 10/1897 | Sprain | 141/336 |
| 883,289 | 3/1908 | Burg | 141/336 |
| 1,099,706 | 6/1914 | Lindeen | 141/336 |
| 1,942,282 | 1/1934 | Greene | 141/336 |
| 3,123,106 | 3/1964 | Parhaniemi | 141/336 |

*Primary Examiner*—Henry J. Recla
*Assistant Examiner*—Edward Donovan
*Attorney, Agent, or Firm*—Weintraub, DuRoss & Brady

[57] ABSTRACT

A sealable funnel assembly is disclosed which comprises a funnel body with a stem portion and cup portion, the stem portion having a hollow bore formed therethrough. A core member is coaxially disposed within the funnel body and includes an upper handle portion and an enlarged lower sealing portion which fits sealingly inside the bore to temporarily prevent fluid flow through the funnel assembly. Motion of the handle portion of the core member upwardly or downwardly serves to either seal off the funnel assembly from fluid flow therethrough or to allow fluid flow through funnel assembly. The cup portion may have indicia inscribed thereon to aid in using the apparatus as a measuring device.

4 Claims, 2 Drawing Sheets

22
12
28
20
60
40
42
30
14
58
56
32
34
52
36
16
54

10

42
38
24
26
32

SEALABLE FUNNEL FOR MEASUREMENT AND SPILL PREVENTION

CROSS-REFERENCE TO RELATED APPLICATIONS

The present application is a continuation-in-part of U.S. Ser. No. 325,308 filed Mar. 17, 1989, now abandoned the disclosure of which is hereby incorporated by reference.

BACKGROUND OF THE INVENTION

1. Field of the Invention

The present invention relates to an improved funnel for use in filling a fluid storage container. More particularly, the present invention relates to such an improved funnel having a core member disposed within a funnel stem, the core member being operable to seal the funnel temporarily to prevent fluid flow therethrough.

2. Description of the Prior Art

Funnels have been used in filling fluid storage containers for many years. However, problems are still often encountered with the prior art funnels in that it is often difficult to tell how much volume will be required to fill a fluid storage container, and consequently a user of a prior art funnel would often over fill the container and become aware of this only when fluid spillage occurred. In particular, this problem has been present in the filling of gasoline tanks with gasoline in devices such as lawn mowers, snowblowers, and the like. Heightened awareness of environmental issues makes it desirable that wholesale spillage of gasoline be avoided whenever possible, both to preserve energy resources and to preserve air quality. In addition, measuring devices such as measuring cups are known, but fail to provide precise measuring when needed. Graduated cylinders and the like provide more precision, but are somewhat cumbersome to clean and are not available to the average consumer.

SUMMARY OF THE INVENTION

The present invention provides a means of filling a fluid storage container without overflowing and consequent spillage of the fluid, and also provides an easy way to return a surplus of fluid to a storage container out of which it has been poured.

The present invention provides a sealable funnel which can be used to fill a fluid storage container to a level just below that of a fill neck thereof. The funnel assembly of the present invention may be sealed off to prevent fluid flow therethrough at the discretion of a user, and may be unsealed to return any excess contents thereof to a storage container after insertion of the funnel into the storage container.

A sealable funnel assembly in accordance with the present invention comprises:

(a) a funnel body comprising a stem portion and a cup portion, the stem portion having a hollow bore formed therethrough, the cup portion being connected to the stem portion and communicating with the hollow bore;

(b) a core member comprising an upper handle portion and an enlarged lower sealing portion attached thereto, the lower sealing portion being dimensioned to fit sealingly inside the hollow bore to temporarily prevent fluid flow therethrough; and (c) means in the bore for limiting upward movement therein of the sealing portion of the core member.

The lower sealing portion of the core member may have a circumferential groove formed therearound, and the assembly may further comprise an O-ring disposed in the circumferential groove of the sealing portion to enhance the sealability of the core member in the bore.

The lower sealing portion of the core member may taper from a wide section adjacent the bottom thereof to a narrow section adjacent the handle section of the core member, and the means in the bore for limiting upward movement of the lower sealing portion may comprise an upwardly narrowing tapered section formed within the bore. The funnel assembly of the present invention, in one embodiment, further comprises a sleeve attachable to the outside of the stem portion, the sleeve being sealingly engagable with a fill neck of a fluid storage container, the sleeve comprising means for limiting downward movement of the core member within the bore.

For a more complete understanding of the present invention, reference is made to the following detailed description section. Throughout the following description and in the claims, identical reference numbers are used to refer to the same components shown in multiple figures of the drawings, in which:

DETAILED DESCRIPTION OF THE PREFERRED EMBODIMENT

Figure 1:
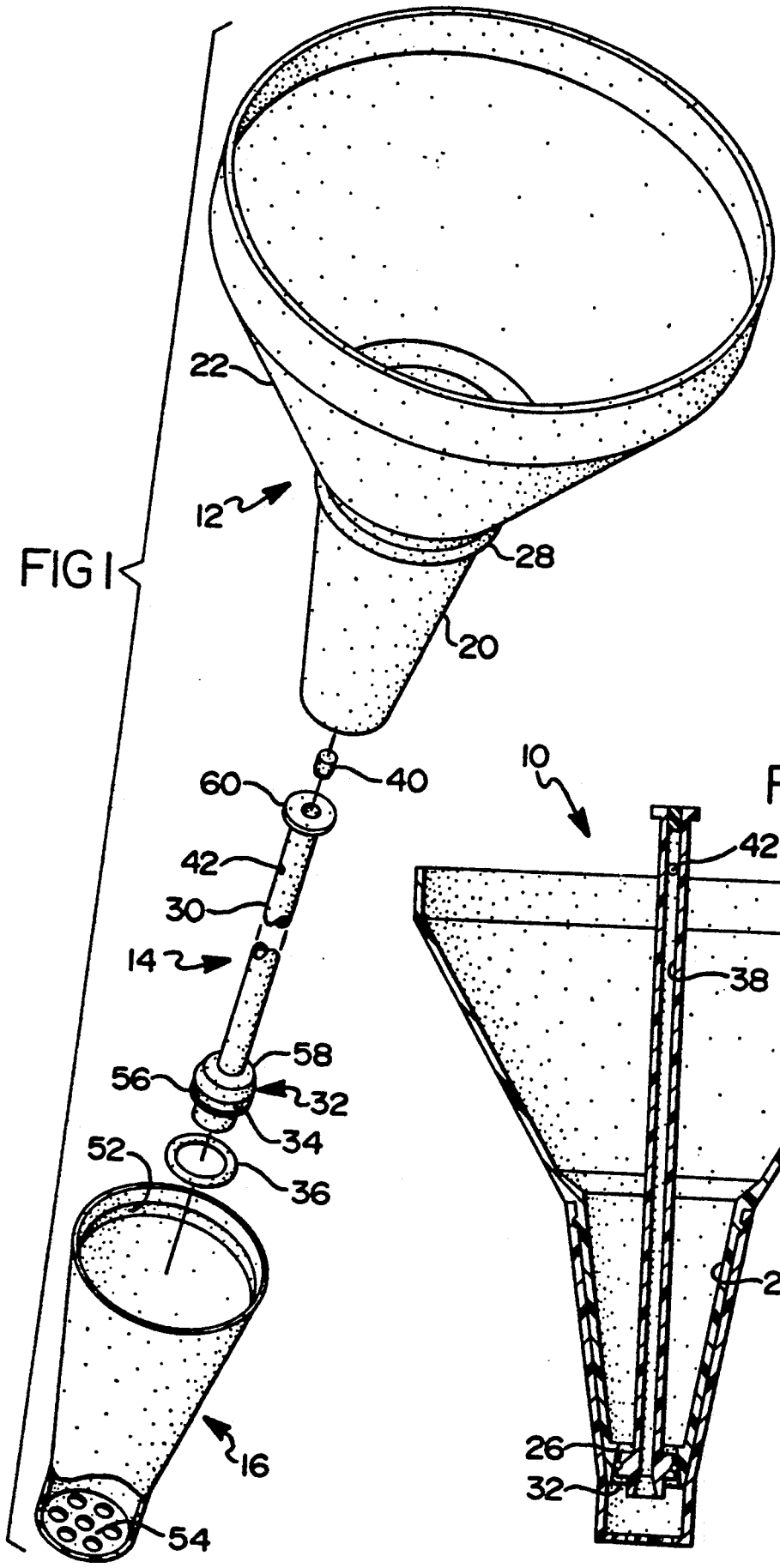
FIG. 1 an exploded perspective view, of the funnel assembly of the present invention.

Referring to the drawings, a sealable funnel assembly in accordance with the present invention is shown generally at 10. The main sections making up the funnel assembly of the present invention are a funnel body 12, a core member 14, and a sleeve 16 which is attachable to the funnel body 12.

As seen in FIG. 1, the funnel body 12 comprises a stem portion 20 and a cup portion 22. The stem portion 20 has a hollow bore 24 formed therethrough, with an upwardly narrowing conical tapered section 26 formed at the bottom of the bore 24. The stem portion 20 is attached to the cup portion 22 for fluid flow from the cup portion through the stem portion and out the bottom of the bore 24. The funnel body 12 is preferably integrally formed as a one-piece unit. A suitable material for the funnel body is, e.g., polypropylene or any other inert material. The stem portion 20 may have a circumferential bead 28 running around the periphery thereof, for attachment of a sleeve 16 thereto as will be described hereinbelow.

Figure 4:
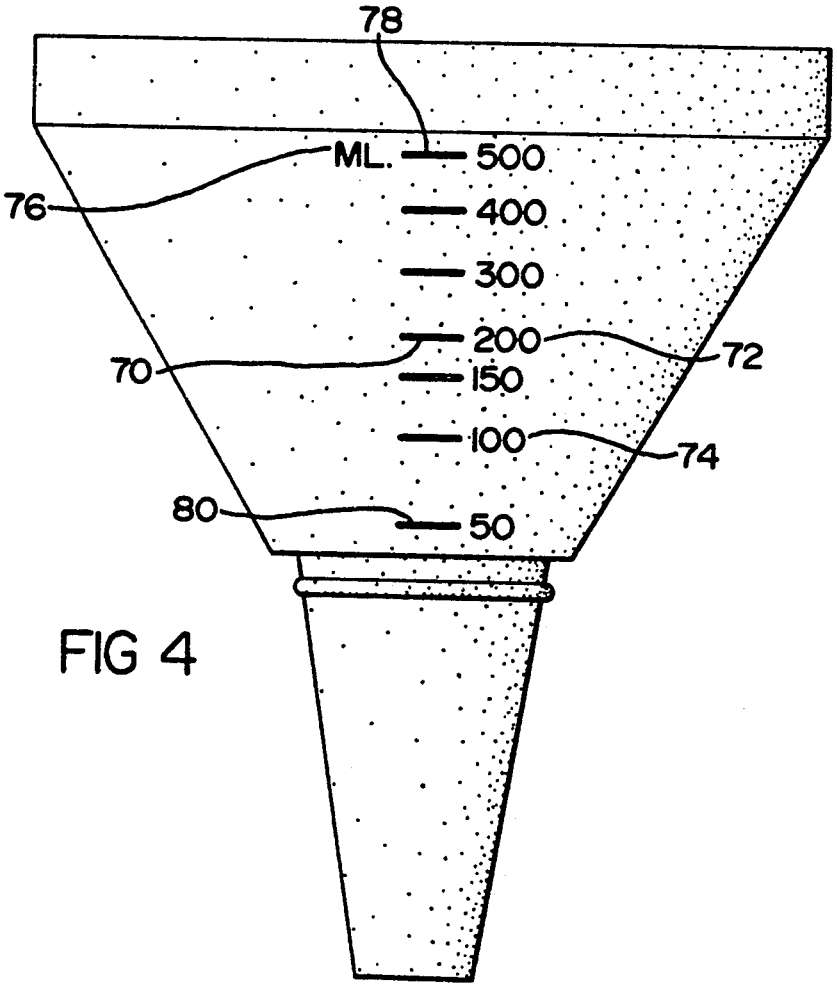
FIG. 4 is a side plan view of a preferred embodiment of the funnel body.

The cup portion 22 is a generally conical hollow body open at the top. As seen in FIG. 4, the exterior of the cup portion 22 may have indicia thereon, such as measuring lines 70 and the corresponding volume numbers 72, 74, to aid in measuring fluid volumes within the funnel body 12. The measurement increments may be in fluid ounces, in milliliters as shown by the marking 76 in FIG. 4, or in other fluid units known to those skilled in the art, such as a gallon mixing ratio, e.g., 4 to 1, 6 to 1, 8 to 1, etc. Moreover, multiple sets of measurement markings may be placed on a single funnel, such as milliliters on one side, fluid ounces on a second side, and a ratio marking scale on a third side. Of course, the measurements marked on the funnel body 12 would take into account the volume within the funnel body 12 displaced by the core member 14.

A core member 14 is shown comprising an upper handle portion 30 which may have a flange 60 at an uppermost end thereof for grasping by a user of a funnel assembly 10, and an englarged lower sealing portion 32 attached to the bottom of the handle portion 30. The lower sealing portion 32 is dimensioned to fit sealingly inside the upwardly narrowing tapered section 26 of the hollow bore 24 to temporarily prevent fluid flow therethrough. The upwardly tapering portion 26 of the bore 24 provides means in the bore 24 for limiting upward movement therein of the sealing portion 32 of the core member 14. One skilled in the art will realize that other means for limiting upward movement of the sealing portion may be used, such as e.g., a sealing portion which is substantially cylindrical in shape in combination with a collar formed within the bore 24 of a smaller diameter then the diameter of the sealing portion 32.

Figure 2:
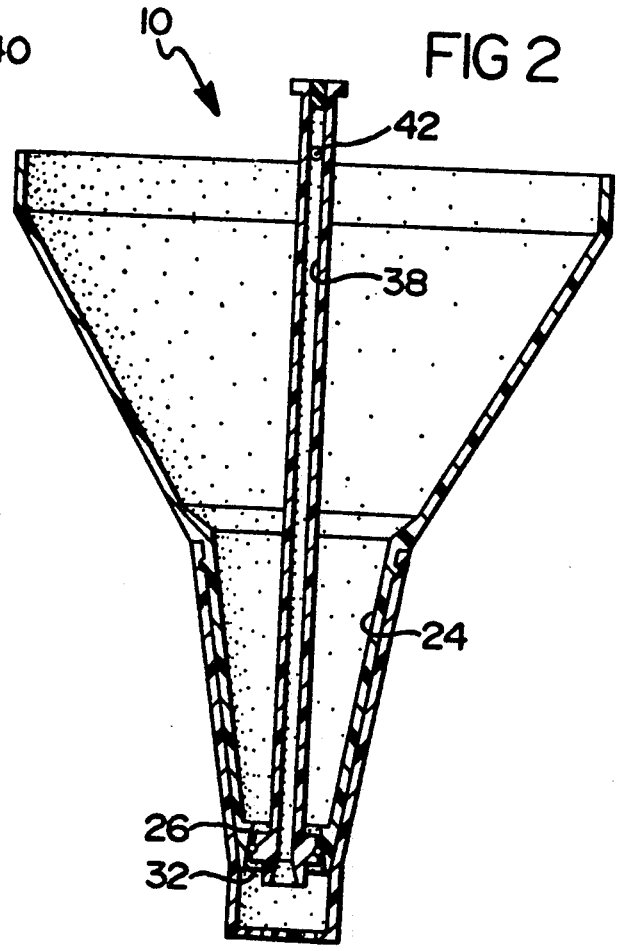
FIG. 2 is a side plan view, partially in cross-section of the funnel assembly of FIG. 1.

As seen in FIGS. 1–2, the sealing portion 32 is provided with a circumferential groove 34 formed therearound, and an O-ring seal 36 may be provided in the circumferential groove 34 to enhance the sealability of the core member 14 in the bore 24. In the embodiment of FIG. 1, the sealing portion 32 tapers from a wide section 56 adjacent the bottom thereof to a narrow section 58 adjacent the handle portion 30, and the core member 14 is disposed coaxially within the funnel body 12.

As seen in FIG. 2, the core member 14 may be provided with a vent passageway 38 formed coaxially therein, the passageway 38 allowing for pressure equalization below the sealing portion 32 of the core member 14 and outside the assembly 10 when the sealing portion 32 is sealingly engaged in the bore 24 of the funnel body 12. This passageway 38 is not required for the present invention. As seen in FIG. 4 an end plug 40 may be provided to plug the upper portion of the passageway 38 in the handle section 30 of the core member 14. A hole or holes 42 may be formed transversely through the handle portion 30 to complete the vent passageway 38. This arrangement prevents sudden splashing of fluid upwardly out of the vent passageway 38, towards a user of the funnel assembly 10.

Figure 3A:
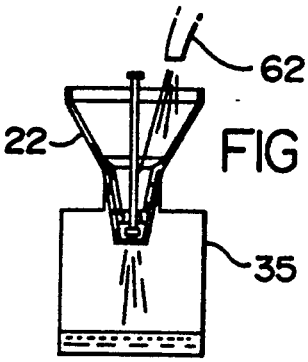
FIG. 3A–3D are a sequence of side cross-sectional views of the funnel assembly of the present invention in the process of filling a fluid storage container.

In the drawings, a sleeve 16 is shown which is attachable to the outside of the stem portion 20 of the funnel body 12. One possible means of attachment of the sleeve 16 to the funnel body 12 is by a circumferential groove 52 being formed just inside of the top edge of the sleeve 16 around the circumference thereof as shown in FIG. 1. The circumferential groove 52 engages with the circumferential bead 28 on the outside of the cup portion 20 of the funnel body 12 and the sleeve 50 is preferably formed from a resilient material so as to be flexible to allow engagement between the circumferential groove 52 and the circumferential bead 28. A suitable material for the sleeve is, e.g., polyethylene or a suitable resilient elastomer which is resistant to gasoline and other hydrocarbons. Another advantage of having the sleeve 16 formed from such a resilient flexible material is that this allows the sleeve to be sealably engagable with a fill neck 50 of a fluid storage container 35 as shown in FIG. 3A to form an air tight seal. This aids in the spill prevention capability of the present funnel assembly 10 as will be further described herein.

A further advantage of having the sleeve 16 formed from a resilient material is that the sleeve 16 is thus removable to allow removal of the core member 14 from the funnel body 12 for maintenance, cleaning, or repair.

At the bottom surface of the sleeve 16 is formed a grid or grate 54 as shown in FIG. 1. This grid may be similar to a screen or may be made up of holes formed through the flat bottom surface of the sleeve 16. The sleeve 16 with the grid 54 formed therein serves as a means for retaining the sealing portion 32 of the core member 16 within the funnel assembly 10 when the sleeve 16 is attached to the stem portion 20 of the funnel body 12.

Figure 3B:
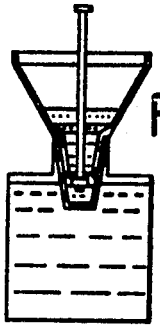
Figure 3C:
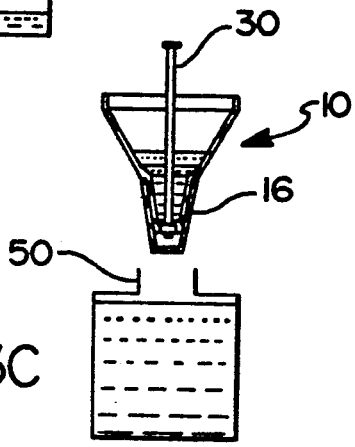
Figure 3D:
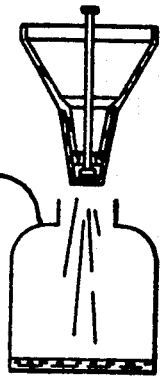

Usage of the funnel assembly 10 of the present invention will now be described, with reference to FIGS. 3A–3D. The sleeve 16 is fitted into a fill neck 50 of a fluid storage container 35, such as a gasoline tank of a lawn mower or the like, and the tapered exterior of the sleeve 16 allows for vertical adjustment to be made until a seal is formed between the sleeve 50 and the fill neck 50. This seal is airtight because the sleeve 16 is formed from a resilient material. The handle portion 30 of the core member is then pushed downwardly to allow fluid to pass from the cup section 22 through the stem portion 20 and out through the bottom of the sleeve 50. A user then observes the fluid level within the cup portion 22 of the funnel assembly while pouring fluid from a source container 62 into the funnel body 12, and when the fluid level does not go downwardly in the cup portion 22, fluid is no longer added thereto. At this point, once the fluid level within the fluid storage container rises above the grate 54 at the bottom of the sleeve 16 as shown in FIG. 3B, air pressure within the fluid storage container surrounding the sleeve 16 will not allow the fluid level in the fluid storage container to rise substantially higher than the level of the grate 54 because of the air tight seal between the sleeve 16 and the fill neck 50. At this point the handle portion is pulled upwardly as shown in FIG. 3B to seat the sealing section 32 within the upwardly narrowing tapered portion 26 of the bore 24. This temporarily prevents fluid flow out of the funnel assembly 10. The funnel assembly 10 as a unit is then removed from the fluid storage container 35 with the sealing section still sealed against the bore 24, and the grate 54 or outlet of the funnel is placed above or within the source container 62 for the fluid. The handle 14 is then pushed downwardly to unseat the sealing section 32 from the bore 24, thus allowing fluid to flow outwardly from the grate 54.

When using the funnel assembly 10 as a measuring device, the core member 14 is pulled upwardly to seal off the funnel body 12, which is then filled with a fluid to be measured until the fluid reaches a desired measuring line, such as the top measuring line 78. The lower end of the assembly 10 having the grate 54 formed therein is then inserted into a destination vessel such as that shown as that shown at 35 in FIG. 3A. A user of the assembly 10 knowing how much fluid was required, could determine which mark would represent that amount. For example, if the embodiment shown in FIG. 4 were used, and 450 ml of fluid was required, the funnel would be filled to the top measuring line 78, the core member would be gently pushed downwardly until the fluid level began to move downwardly in the funnel, and then the core member 14 would be pulled upwardly to reseal the assembly 10 when the fluid level reached the bottom measuring line 80. Alternatively, the entire contents of the funnel could be added as a measured amount.

It is the sealability of this funnel design that makes it possible to adapt it to be used as a measuring device.

Although the present invention has been described herein with respect to specific embodiments thereof, it will be understood that the foregoing description is intended to be illustrative, and not restrictive. Many modifications of the present invention will occur to those skilled in the art. All such modifications will fall within the scope of the appended claims are intended to be within the scope and spirit of the present invention.

Having, thus, described the invention, what is claimed is:

1. A sealable funnel assembly comprising:

(a) a funnel body comprising a stem portion and a cup portion, the stem portion having a hollow bore formed therethrough, the cup portion being connected to one end of the stem portion and communicating with the hollow bore, the opposite end of said stem portion defining a valve seat therewithin;

(b) a core member comprising an elongated handle portion extending through said cup portion and stem portion, the core member further comprising an enlarged lower sealing portion attached to the handle portion, the lower sealing portion dimensioned to fit sealingly inside the valve seat of the hollow bore to temporarily prevent fluid flow therethrough, said core member having a vent passage formed therethrough; and (c) sealing means surrounding said stem portion and removably secured thereto for sealingly engaging with an inlet of a receptacle, said sealing means including a portion extending over the opposite end of said stem portion to limit downward movement of said sealing portion with respect to said funnel body.

2. The funnel assembly of claim 1, wherein the lower sealing portion of the core member has a circumferential groove formed therearound, the assembly further comprising an O-ring seal disposed in the circumferential groove of the sealing portion to enhance the sealability of the core member in the bore.

3. The funnel assembly of claim 1, wherein the lower sealing portion of the core member tapers from a wide section adjacent to the bottom thereof to a narrow section adjacent the handle portion, and the valve seat comprises an upwardly narrowing tapered section in the bore, the sealing portion of the core member being constructed and arranged to fit sealingly therein.

4. The funnel assembly of claim 1, wherein the cup portion has indicia thereon to aid in measuring fluid volumes within the assembly.

* * * * *